US010546515B2

(12) United States Patent
Kitzerow et al.

(10) Patent No.: US 10,546,515 B2
(45) Date of Patent: Jan. 28, 2020

(54) CLAMP HAVING MULTIPLE CONTACT FEATURES

(71) Applicant: AMERICAN LOUVER COMPANY, Skokie, IL (US)

(72) Inventors: Scott Kitzerow, Lindenhurst, IL (US); Daniel Calby, Park Ridge, IL (US)

(73) Assignee: AMERICAN LOUVER COMPANY, Des Plaines, IL (US)

( * ) Notice: Subject to any disclaimer, the term of this patent is extended or adjusted under 35 U.S.C. 154(b) by 0 days.

(21) Appl. No.: 15/425,301

(22) Filed: Feb. 6, 2017

(65) Prior Publication Data

US 2018/0226000 A1 Aug. 9, 2018

(51) Int. Cl.
*G09F 7/18* (2006.01)
*E01F 9/692* (2016.01)

(52) U.S. Cl.
CPC ..... *G09F 7/18* (2013.01); *E01F 9/692* (2016.02); *G09F 2007/1804* (2013.01); *G09F 2007/1847* (2013.01); *G09F 2007/1856* (2013.01); *G09F 2007/1878* (2013.01)

(58) Field of Classification Search
CPC ..... G09F 7/18; G09F 2007/1804; G09F 2007/1813; G09F 2007/1847; G09F 2007/1856; G09F 2007/1878
See application file for complete search history.

(56) References Cited

U.S. PATENT DOCUMENTS 1,070,049 A * 8/1913 Machava ..... B25B 1/103 269/251
1,188,935 A 6/1916 Heagany et al.
1,854,478 A * 4/1932 Meyers ..... A24F 19/0092 248/230.2
2,882,656 A * 4/1959 Novkov ..... B25B 1/103 269/258
4,288,053 A * 9/1981 Sarkisian ..... G09F 7/18 248/218.4
4,309,836 A * 1/1982 Knapp ..... G09F 7/002 40/602
4,433,935 A * 2/1984 Main ..... E01F 9/662 248/125.3
4,507,887 A 4/1985 Seely
4,544,125 A 10/1985 Seely
4,548,379 A 10/1985 Seely et al.
4,569,499 A 2/1986 Seely
4,572,473 A 2/1986 Seely
4,575,040 A 3/1986 Seely
4,592,158 A 6/1986 Seely
4,593,879 A 6/1986 Seely et al.
4,619,220 A 10/1986 Seely et al.
4,691,892 A 9/1987 Grewe et al.
(Continued)

*Primary Examiner* — Gary C Hoge
(74) *Attorney, Agent, or Firm* — McDermott Will & Emery LLP

(57) ABSTRACT

A clamping system includes a mast, a bracket clamp engageable with the mast, the bracket clamp including a receiver for receiving a sign, a compression assembly for compressing the mast and the receiver towards each other, and a compression element movable relative to the receiver by the compression assembly, the compression element contacting a side surface of the mast via a plurality of contact features, each contact feature contacting the side surface of the mast at a distinct location on the side surface of the mast.

22 Claims, 8 Drawing Sheets

(56) References Cited

U.S. PATENT DOCUMENTS 4,737,048 A 4/1988 Herrstrom
4,888,894 A 12/1989 Brown, Jr.
4,954,008 A 9/1990 Dicke et al.
5,181,335 A * 1/1993 Todd ..... G09F 7/18 248/125.1
5,318,258 A 6/1994 Lang
5,340,068 A 8/1994 Sarkisian et al.
5,472,162 A 12/1995 Mason
5,611,509 A 3/1997 Kulp et al.
5,624,092 A * 4/1997 Kulp ..... G09F 7/18 248/219.1
5,675,923 A 10/1997 Sarkisian et al.
5,725,186 A * 3/1998 Hillstrom ..... E01F 9/688 248/121
5,732,911 A 3/1998 Kulp et al.
5,829,178 A 11/1998 Hillstrom
5,836,558 A 11/1998 Kulp et al.
5,851,001 A 12/1998 Dicke et al.
6,003,827 A * 12/1999 Kulp ..... G09F 15/0062 248/176.1
6,186,463 B1 2/2001 Williams et al.
6,237,883 B1 5/2001 Levin et al.
6,315,251 B1 11/2001 Stoudt et al.
6,315,253 B1 11/2001 Dicke et al.
6,427,964 B1 8/2002 Hillstrom et al.
6,430,855 B1 8/2002 Gertz et al.
6,560,906 B1 5/2003 Hillstrom
6,604,719 B1 8/2003 Dicke et al.
6,606,809 B2 8/2003 Hillstrom et al.
6,622,408 B2 9/2003 Dicke et al.
6,625,912 B2 9/2003 Dicke et al.
6,626,410 B2 9/2003 Marcotte et al.
6,685,156 B2 2/2004 Dicke et al.
6,755,381 B1 6/2004 Levin et al.
6,792,708 B2 9/2004 Dicke et al.
6,793,191 B1 9/2004 Williams et al.
6,915,605 B2 7/2005 Lavoie
7,243,450 B2 7/2007 Dicke et al.
7,458,554 B1 12/2008 Levin et al.
7,669,815 B2 3/2010 Clewett
7,686,264 B2 3/2010 Dicke
7,997,547 B1 * 8/2011 Maus ..... G09F 15/0025 248/218.4
8,117,776 B1 2/2012 Maus
8,122,629 B2 2/2012 Cowgill
2005/0072883 A1 * 4/2005 Michaud ..... F16L 3/105 248/74.1
2008/0236010 A1 10/2008 Levin
2010/0058635 A1 3/2010 Knapp et al.
2010/0072240 A1 * 3/2010 Comes ..... B25B 1/103 224/536
2014/0020231 A1 * 1/2014 Raczuk ..... B25B 27/10 29/525.01

* cited by examiner

FIG. 7
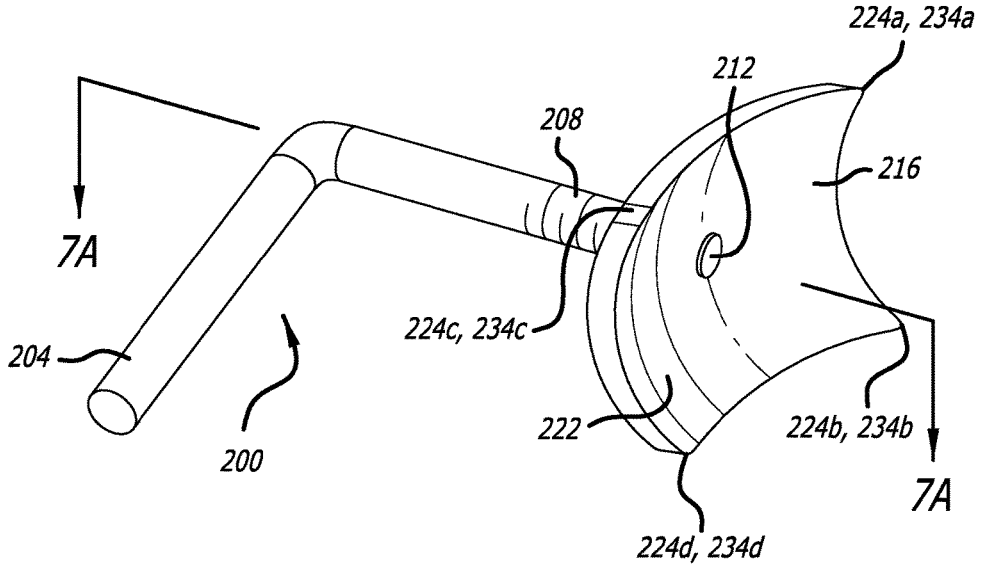
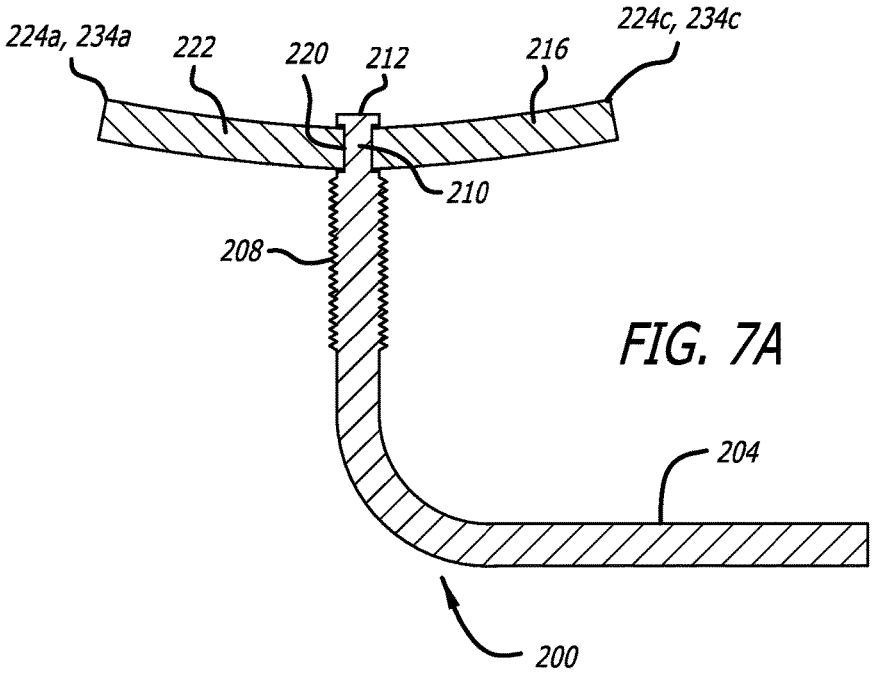
FIG. 7A

CLAMP HAVING MULTIPLE CONTACT FEATURES

TECHNICAL FIELD

The present disclosure generally relates to a mechanical attachment system. In particular, a clamping member is provided and includes a plurality contact features.

BACKGROUND

Standard sign stands are generally known in the art. Some sign stands include features such as folding legs for enhanced stability and storage properties, while others include various mounts for flexible or rigid signs. However, conventional mounting and clamping systems found on existing sign stands do not adequately address potential sign mount, sign and mounting bracket instability relative to a base or a mast. Such conventional mounting and clamping systems result in component stress or sign stand failure when conventional sign mounts, which are disposed in contact with particular mast sections and/or include a particular number or arrangement of contact features, are faced with an impact, adverse weather conditions or repeated component manipulations. The accessories or integrated features available on these and other known sign stands do not safely and purposefully address these issues. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

In some implementations of the present disclosure, a clamping system provides a mast, a bracket clamp engageable with the mast, the bracket clamp including a receiver for receiving a sign, a compression assembly for compressing the mast and the receiver towards each other, and a compression element movable relative to the receiver by the compression assembly, the compression element contacting a side surface of the mast via more than one contact feature, each contact feature contacting the side surface of the mast at a distinct location on the side surface of the mast.

In some implementations of the present disclosure, a clamping system provides a mast, a bracket clamp engageable with the mast, the bracket clamp including a receiver for supporting a sign, a compression assembly for compressing the mast and the receiver towards each other, and a compression element movable relative to the receiver by the compression assembly, the compression element contacting a side surface of the mast with more than one contact feature, each contact feature contacting the side surface of the mast at a location closer to an edge of the side surface of the mast than to a center of the side surface of the mast.

In some implementations, the present disclosure provides a clamping system for removably attaching a mast to a receiver, said clamping system comprising a mast, a bracket clamp at least partially surrounding the mast, a compression assembly operatively associated with the bracket clamp, and a compression element movable by the compression assembly, the compression element contacting a side surface of the mast with more than one contact feature, each contact feature contacting the side surface of the mast at a distinct location on the side surface of the mast.

BRIEF DESCRIPTION OF THE DRAWINGS

To understand the present disclosure, it will now be described by way of example, with reference to the accompanying drawings in which implementations of the disclosures are illustrated and, together with the descriptions below, serve to explain the principles of the disclosure.

FIG. 7 is a perspective view of a bolt lever and a compression element according to exemplary implementations of the present disclosure.

FIG. 7A is a cross-sectional view taken along line 7A-7A of FIG. 7 according to exemplary implementations of the present disclosure.

DETAILED DESCRIPTION

Figure 1:
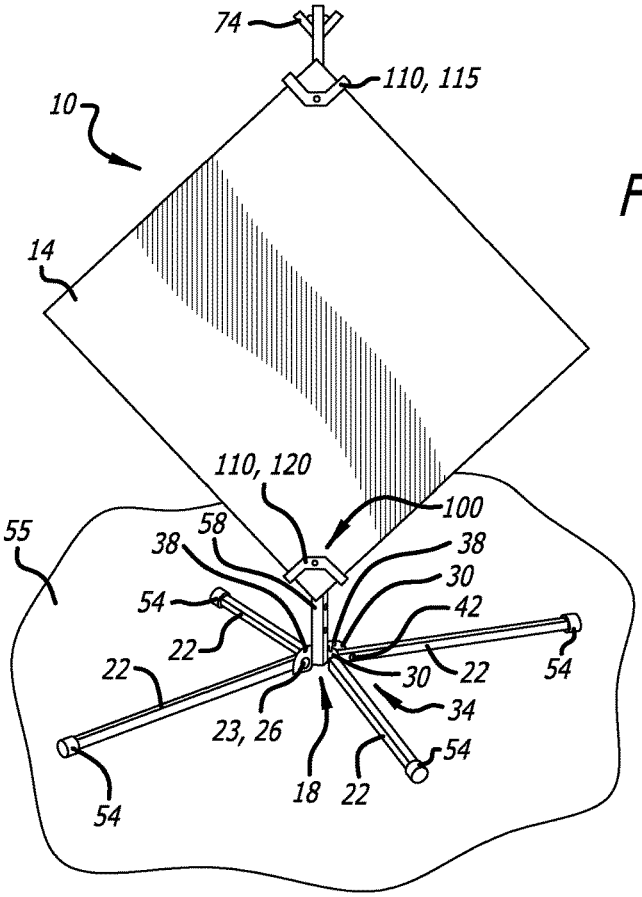
FIG. 1 is a perspective view of a sign stand according to exemplary implementations of the present disclosure.

While the sign support system discussed herein may be implemented in many different forms, the disclosure will show in the drawings, and will herein describe in detail, implementations with the understanding that the present description is to be considered as an exemplification of the principles of the sign support system and is not intended to limit the broad aspects of the disclosure to the implementations illustrated.

A sign stand 10 is commonly used to convey information, direct road traffic and alert road traffic to various conditions. Although often used in conjunction with road traffic, sign stands 10 can also be employed in industrial, construction and crowd-control applications. Enhancements to the stability, portability and/or visibility of such sign stands increase sign stand 10 utility.

Referring now to the figures, and initially to FIGS. 1-4, in some implementations the sign stand 10 includes, and/or supports, a sign 14. The sign 14 can be rigid or flexible, and can include various colors, reflective materials, lights and messages. The sign stand 10 also includes a base 18 providing support for the sign stand 10. The base 18 includes a plurality of legs 22 pivotally attached to the base 18 at pivot points 23. Pivot elements 26, arranged at pivot points 23, enable the legs 22 to pivot relative to the base 18. Pivot points 23 may be disposed in, or on, leg mounting plates 30, which are attached to the base 18 and form portions of the base 18.

A leg locking system 34 is, in some implementations, disposed between at least one of the legs 22 and the base 18. The leg locking system 34 enables a leg 22 to selectively transition between, and lock in, deployed and folded positions. The leg locking system 34 includes a pin 42 selectively insertable into a recess 38 formed in a leg mounting plate 30. A deployed position, as shown in FIGS. 1-4, allows each leg 22, via a foot 54, to contact a ground surface 55 while the folded position allows the sign stand 10 to be easily stored and transported due to a reduced volume.

A base tube 58 extends upwardly from the base 18 when the legs 22 are in a deployed position and the sign stand 10 is disposed on a ground surface 55. The base tube 58 supports a mast 67, and the base tube 58 and the mast 67 are, in some implementations, telescopically engaged.

Figure 3:
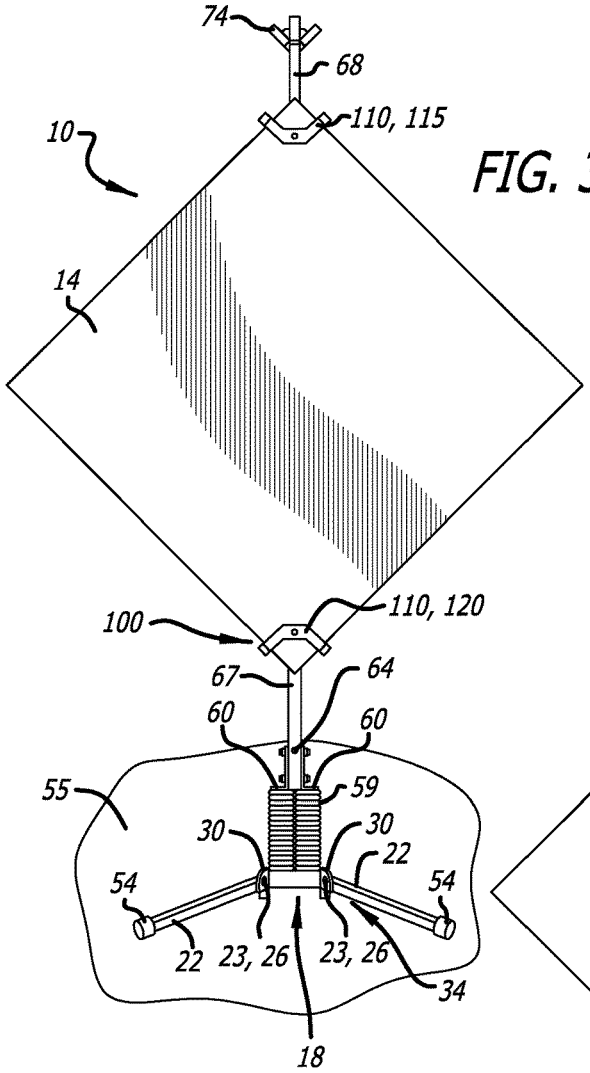
FIG. 3 is a front view of a sign stand according to exemplary implementations of the present disclosure.
Figure 4:
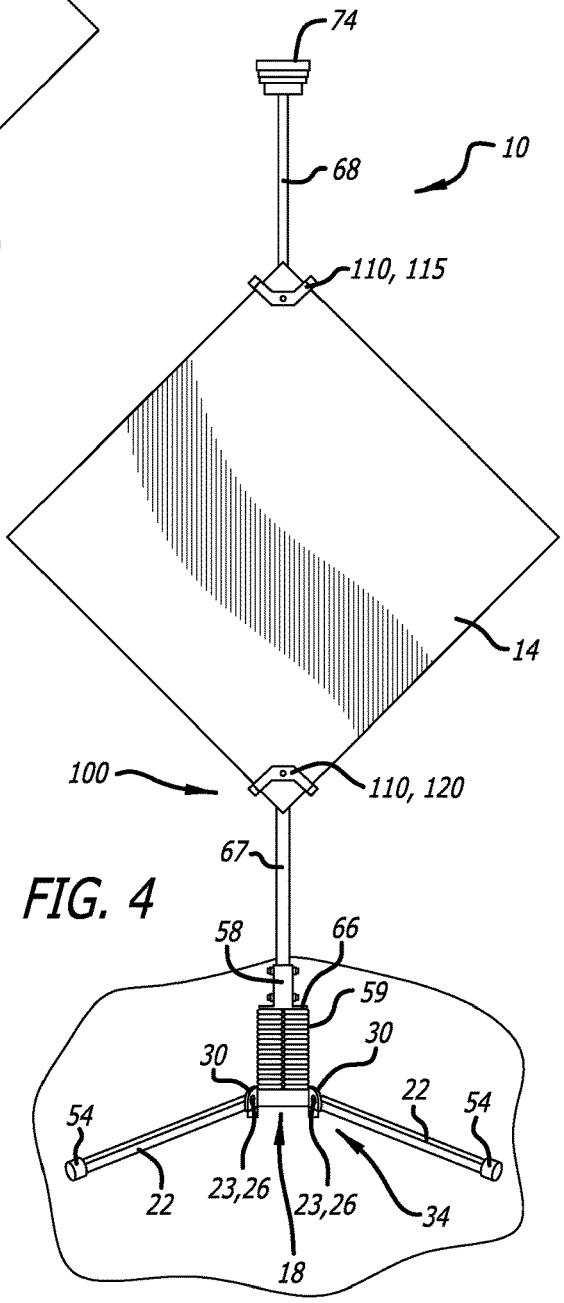
FIG. 4 is a front view of a sign stand according to exemplary implementations of the present disclosure.

In some implementations, a spring element 59 is disposed between the base 18 and the base tube 58, as shown in FIGS. 3 and 4. The spring element 59 may be a coil spring. The spring element 59 serves to allow a degree of freedom between the base 18 and portions of the sign stand 10 located above the base 18, such as the sign 14 and a sign support system or a clamping system 100, which will be described below in further detail.

Certain implementations of the present disclosure, as shown in FIG. 3, include one or more L-brackets 60, which connect to the spring element 59 and also connect to the mast 67 or the base tube 58. A breakaway feature 64 may also be included in the mast 67, and includes a weakened portion designed to facilitate a breaking or reorientation of the sign stand 10 in a particular manner or direction in response to an impact or an adverse condition. In some implementations, as shown in FIG. 4, the sign stand 10 includes a combined spring mount 66, which mounts or forms a base tube 58 or mast 67, while also attaching to one or more spring elements 59.

Figure 5:
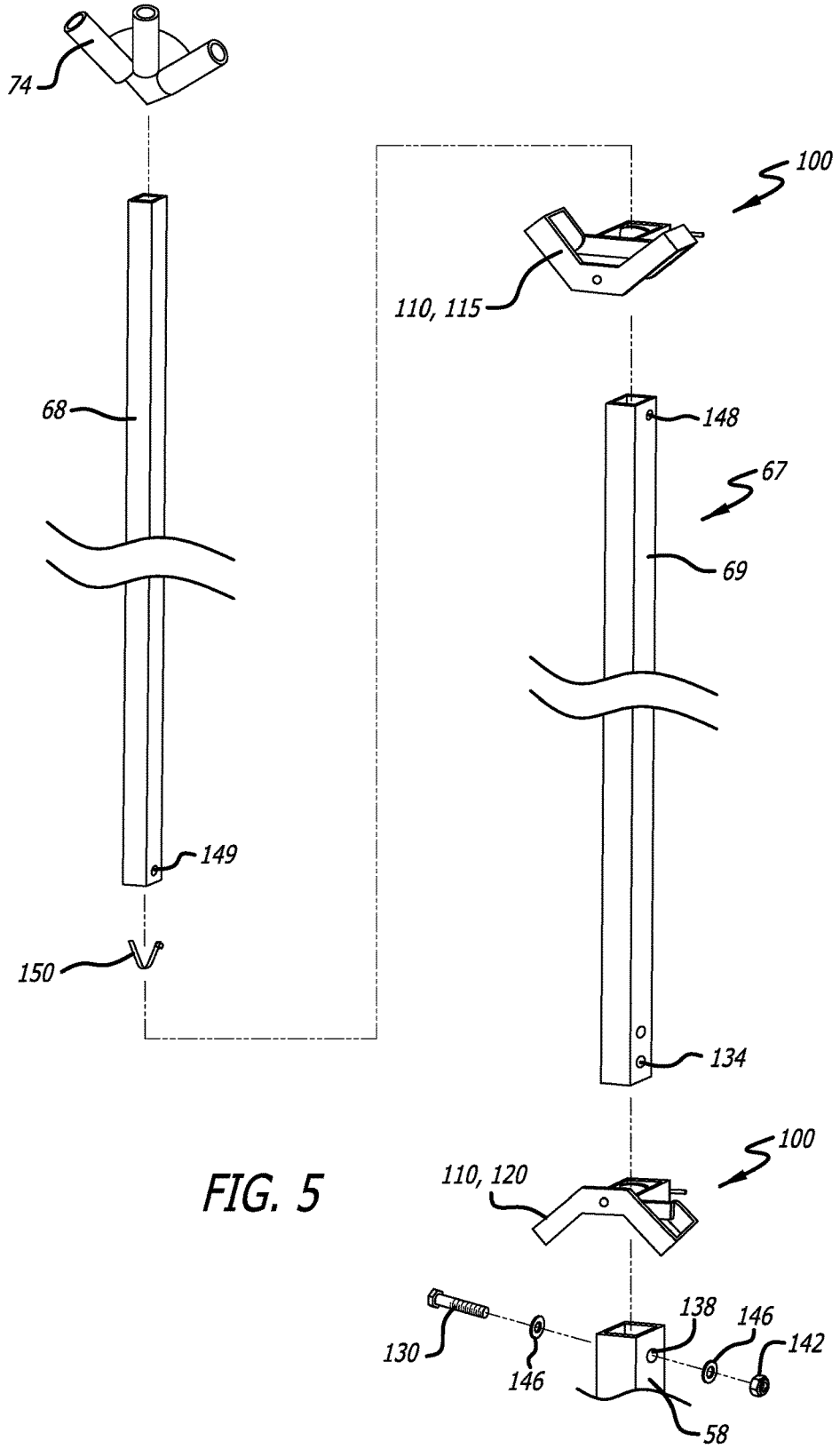
FIG. 5 is an exploded view of a sign support system according to exemplary implementations of the present disclosure.

FIG. 5 is an exploded view of a clamping system or a sign support system 100 according to exemplary implementations of the present disclosure. Generally, the clamping system 100 supports the sign 14 when the sign 14 is mounted on the sign stand 10. The clamping system 100 securely, yet releasably, attaches a sign-supporting element to the sign stand 10 and prevents relative rotation and motion between the sign 14, sign stand 10, elements of the clamping system 100 and other sign stand 10 components, which will be described below.

Figure 2:
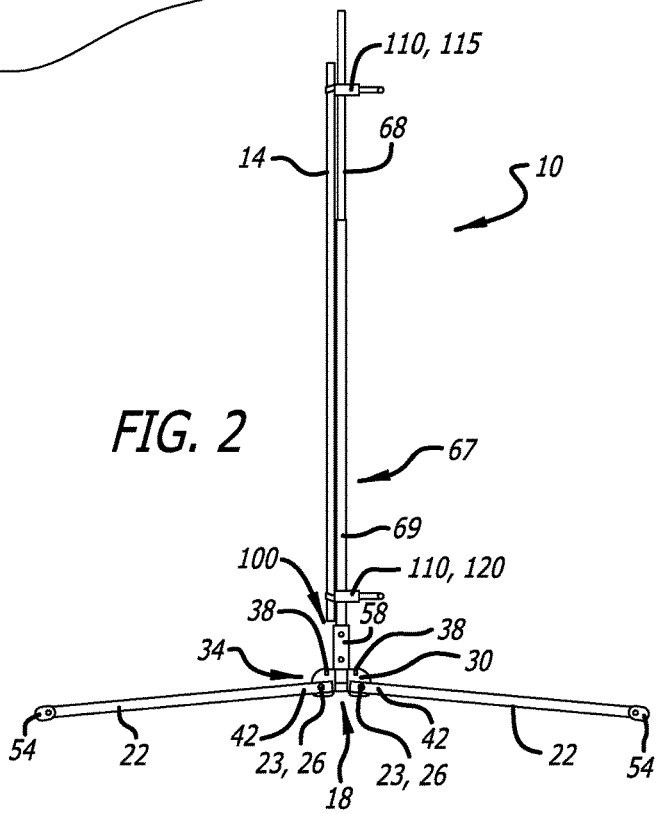
FIG. 2 is a side view of the sign stand of FIG. 1.

Turning to FIG. 2, the mast 67 includes an upper mast 68 and a lower mast 69 in some implementations. The upper mast 68 and the lower mast 69 telescopically engage to form the mast 67. As will be described below in further detail, FIGS. 1-4 illustrate a sign support system 100 including a bracket clamp 110. A single sign stand 10 may include more than one bracket clamp 110, namely an upper bracket clamp 115 and a lower bracket clamp 120. It is to be understood that sign stands 10 including one, two or more than two bracket clamps 110 are within the scope of this disclosure. An upper bracket clamp 115 is, in some implementations, attached to the upper mast 68 while the lower bracket clamp 120 is attached to the lower mast 69. In some implementations the mast 67 is formed from aluminum, however other materials such as polymers, metals, metal alloys and ceramics may be used. The clamping system 100 may be used to mount, to a mast 67, an element that supports, or receives, a sign 14, a portion of a sign 14 or another visual indicator such as a flag or a lighting apparatus.

Returning to FIG. 5, a mast bolt 130 secures the mast 67 to the base tube 58. In detail, the mast bolt 130 passes through a mast lower bolt aperture 134 and a base tube upper aperture 138, which align when the mast 67 is telescopically inserted into the base tube 58. A mast bolt nut 142 and mast bolt washers 146 are cooperatively used with the mast bolt 130 to secure the mast 67 to the base tube 58 and minimize damage to any of the involved components.

Additionally, a connector 150, which in various implementations is a spring button, bolt, pin or other mechanical connector, is disposed within the mast 67 when the upper mast 68 and the lower mast 69 are telescopically engaged. The connector 150 passes through one or more of a lower mast connection aperture 148 and an upper mast connection aperture 149 to releasably secure the upper mast 68 to the lower mast 69.

FIG. 5 also shows a sign support system 100 including a bracket clamp 110. As shown, an upper bracket clamp 115 and a lower bracket clamp 120 are arranged on the mast 67. In particular, the upper bracket clamp 115 is attached to the mast 67 in a first orientation while the lower bracket clamp 120 is attached to the mast 67 in a second orientation. The first orientation and the second orientation are different from each other and, in some implementations, are different from each other by an angular amount. In some implementations, the first orientation and the second orientation are different from each other by approximately 180 degrees.

Figure 6:
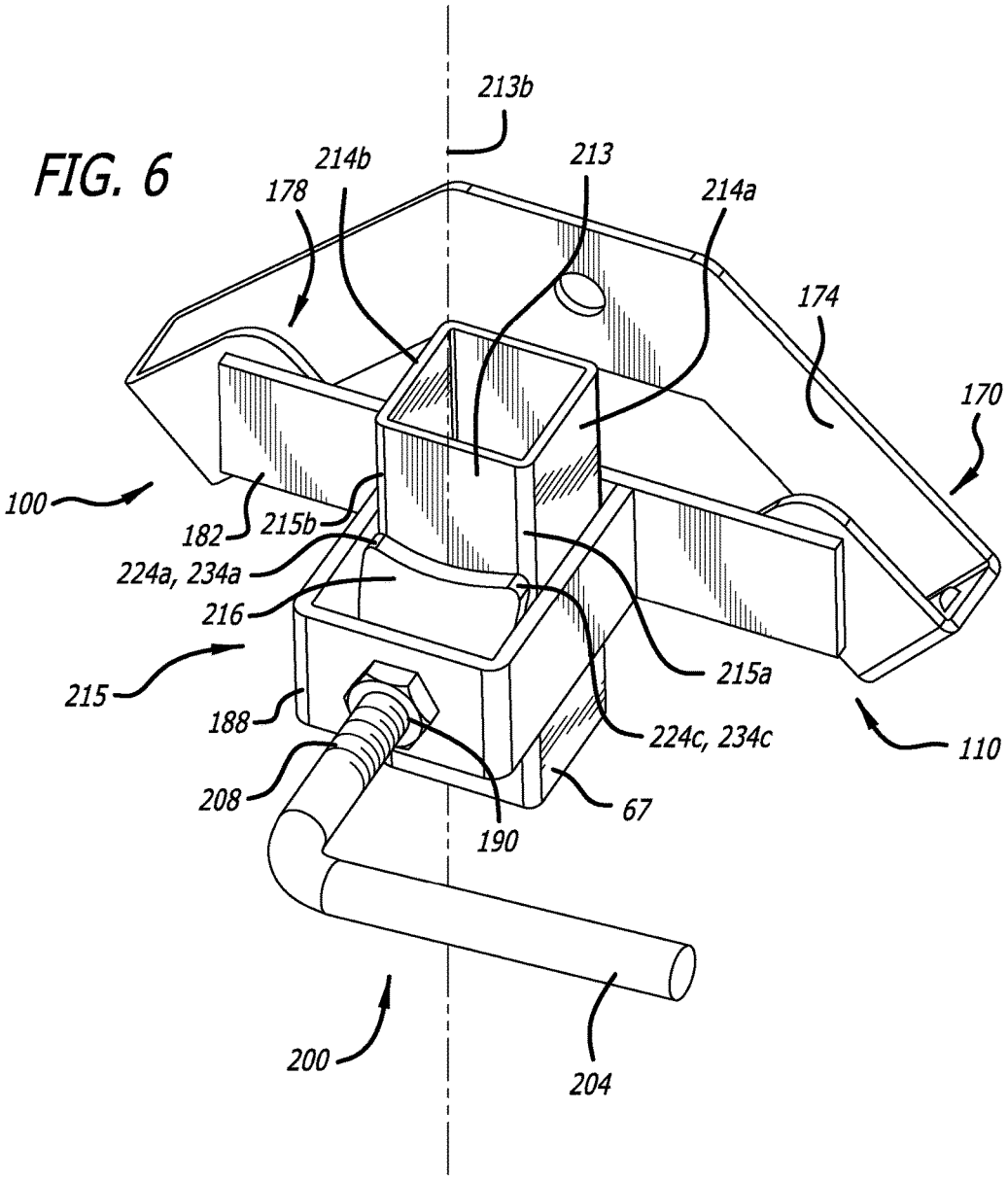
FIG. 6 is a perspective view of a sign support system, including a bracket clamp, according to exemplary implementations of the present disclosure.

Turning to FIG. 6, the sign support system 100 includes a bracket clamp 110 having a bracket body 170. The bracket body 170 includes a receiver 174 for supporting and/or securing a portion of a sign 14. The receiver 174 forms a cradle 178 for supporting and/or securing a portion of the sign 14. A receiver bridge 182 strengthens the receiver 174 and connects the receiver 174 to a brace 188. The brace 188 includes a threaded section 190 and, in some implementations surrounds or partially surrounds the mast 67.

A compression assembly 215 includes the brace 188, threaded section 190 and a bolt lever 200, as well as other components. The compression assembly 215 serves to press the bolt lever 200 towards the mast 67, the receiver 174 and/or the receiver bridge 182, and serves to press the mast 67 towards the receiver 174 and/or receiver bridge 182. The bolt lever 200 includes a handle portion 204 that allows manual rotation, or manipulation, of the bolt lever 200 relative to the threaded section 190. The threaded section 190 is, in some implementations, fixed to the brace 188 by welding or other joining means, and further may be directly formed in the brace 188. Due to the threading interaction between the threaded section 190 and a bolt lever threaded portion 208, a rotation of the bolt lever 200 relative to the threaded section 190 causes a longitudinal translation of the bolt lever 200 relative to the threaded section 190 along an axis defined by the bolt lever threaded portion 208.

Turning to FIGS. 7 and 7A, the bolt lever 200 is shown along with a compression element 216. The compression element 216, in some implementations, is used to contact the mast 67 and compress, via operations of the compression assembly 215, the mast 67 against the receiver 174 and/or receiver bridge 182. Thus, the compression assembly 215, the compression element 16 and the bracket clamp 110 are each operatively associated with one another. In some implementations, the bolt lever 200 is rotatably connected to the compression element 216, while in some implementations they are separate or separable components. As shown in FIG. 7A, some implementations of the bolt lever 200 and/or the bolt lever threaded portion 208 have a narrowed portion 210 and an expanded retainer 212. The compression element 216 may have a compression element aperture 220 formed therethrough, allowing the compression element 216 to be mounted, or rotatably mounted, on the narrowed portion 210. The expanded retainer 212 ensures that the compression element 216 does not become separated from the bolt lever 200. The expanded retainer 212 may be releasably connected to the bolt lever 200, and a removal of the expanded retainer 212 allows different compression elements 216 to be rotatably installed around the narrowed portion 210. In some implementations the compression element 216 is formed from steel, however other materials such as polymers, metals, metal alloys and ceramics may be used.

As further shown in FIG. 7, the compression element 216 includes a compression element body 222. The compression element body 222 includes, mounts or connects to a plurality of contact features 224*a*, 224*b*, 224*c*, 224*d*. The contact features 224*a*, 224*b*, 224*c*, 224*d* contact the mast 67 when the bolt lever 200 is translated relative to the threaded section 190 by relative rotation of the bolt lever 200 and the threaded section 190. The compression element 216 includes a plurality of contact points with the mast 67, or contact features 224*a*, 224*b*, 224*c*, 224*d* to enhance the performance of the sign stand 10 and of the sign support system 100 by increasing a grip of the compression element 216 relative to the mast 67. Such a relative grip, or friction, is enhanced as the compressive energy, between the mast 67 and the compression element 216, generated by the compression assembly 215 is focused at the contact features 224*a*, 224*b*, 224*c*, 224*d*, rather than being distributed over a wider or longer surface area of a part, or all, of the compression element body 222. The compression element 216 can contact the upper mast 68 or the lower mast 69.

Returning to FIG. 6, the contact features 224*a*, 224*b*, 224*c*, 224*d* of the compression element 216 contact a mast contact surface 213. A center of the mast contact surface 213 is indicated by an axis 213*b* traveling along the center of the mast contact surface 213. The mast 67 also includes a first lateral surface 214*a* and a second lateral surface 214*b*, and the connection portion between the mast contact surface 213 and the first lateral surface 214*a* is a first edge 215*a* of the mast contact surface 213, while the connection portion between the mast contact surface 213 and the second lateral surface 214*b* is a second edge 215*b* of the mast contact surface. It can be seen that the contact features 224*a*, 224*c* of the compression element 216 each contact the mast contact surface 213 at a location closer to a first edge 215*a* or the second edge 215*b* than to a center of the mast contact surface 213, indicated by axis 213*b*. It is to be understood that others of the contact features 224*a*, 224*b*, 224*c*, 224*d*, as well as additional or other contact features, also contact the mast contact surface 213 at a location closer to a first edge 215*a* or the second edge 215*b* than to a center of the mast contact surface 213, indicated by axis 213*b*.

As shown in FIGS. 6-7A, some or all of the compression element 216 is shaped according to a portion of a spherical surface. Contact features 224*a*-*d*, in such an implementation, are labeled 234*a*, 234*b*, 234*c*, 234*d*, respectively.

Figure 8A:
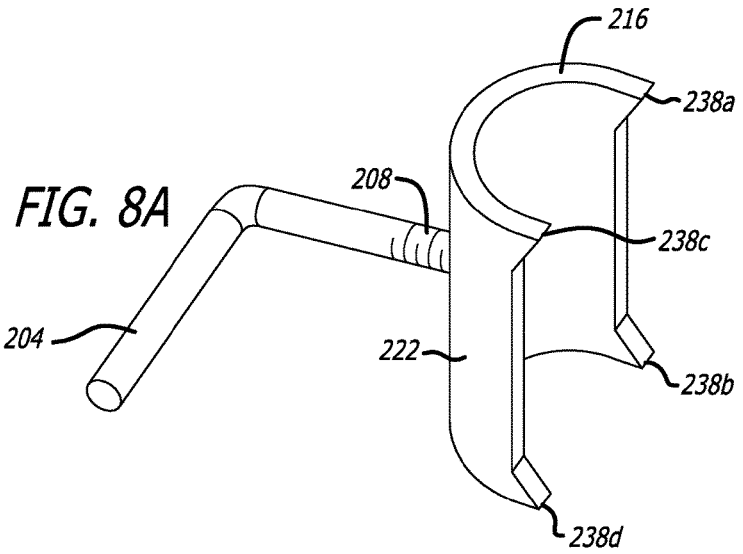
FIGS. 8A-8C are views of a bolt lever and a compression element according to exemplary implementations of the present disclosure.
Figure 8B:
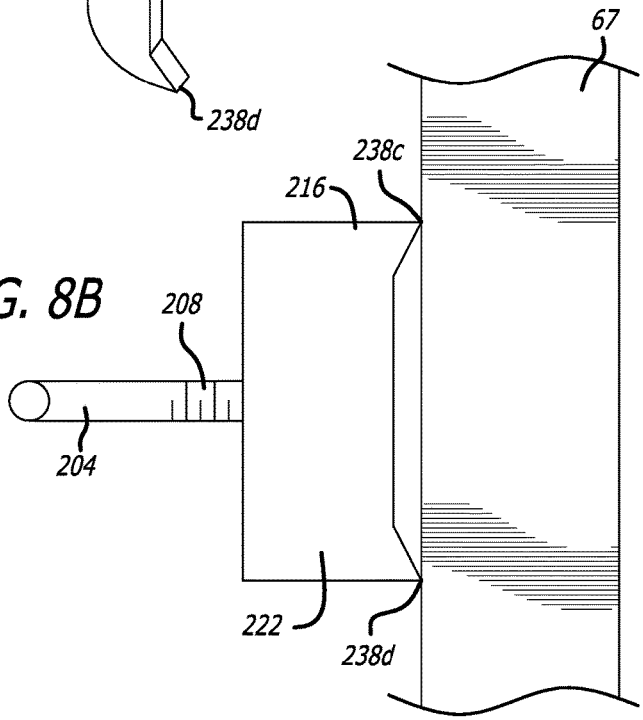
Figure 8C:
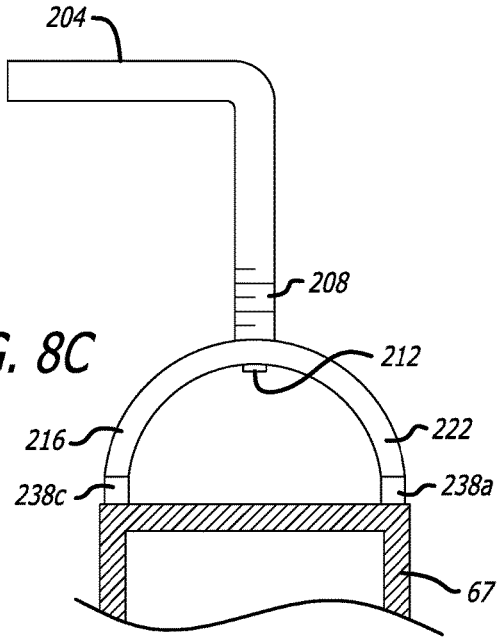

As shown in FIGS. 8A-8C, some or all of the compression element 216 is shaped according to a portion of a cylindrical surface. Contact features 224*a*-*d*, in such an implementation, are labeled 238*a*, 238*b*, 238*c*, 238*d*, respectively.

Figure 9A:
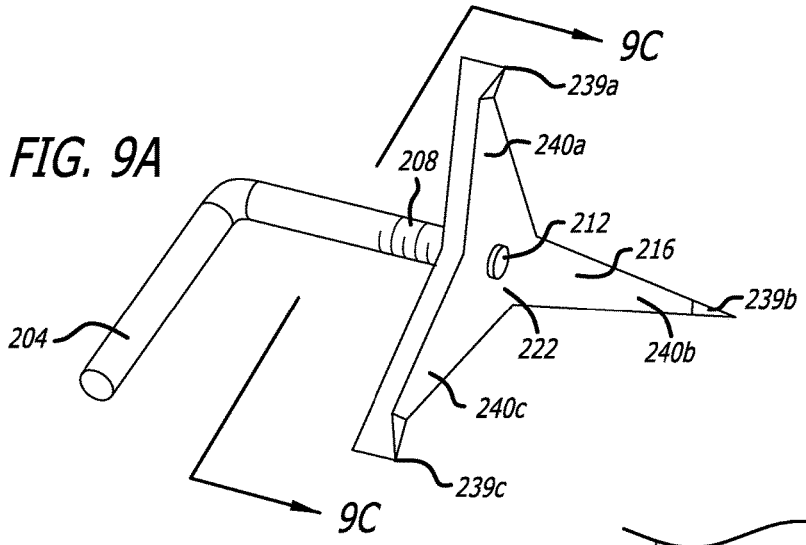
FIGS. 9A-9C are views of a bolt lever and a compression element according to exemplary implementations of the present disclosure.
Figure 9B:
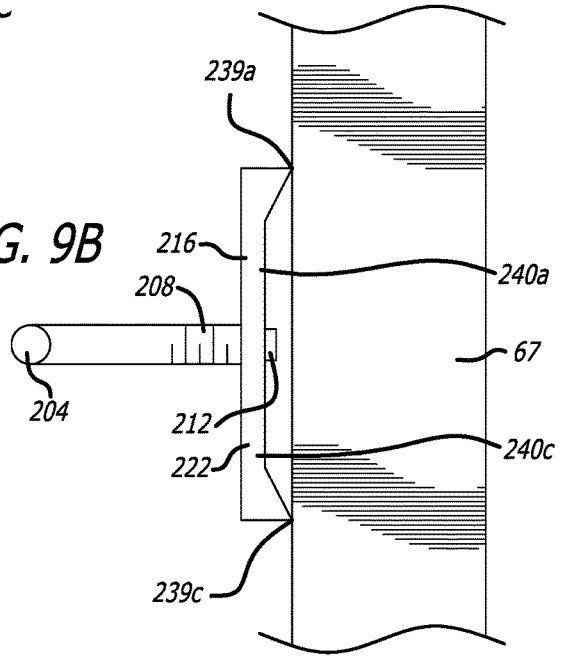
Figure 9C:
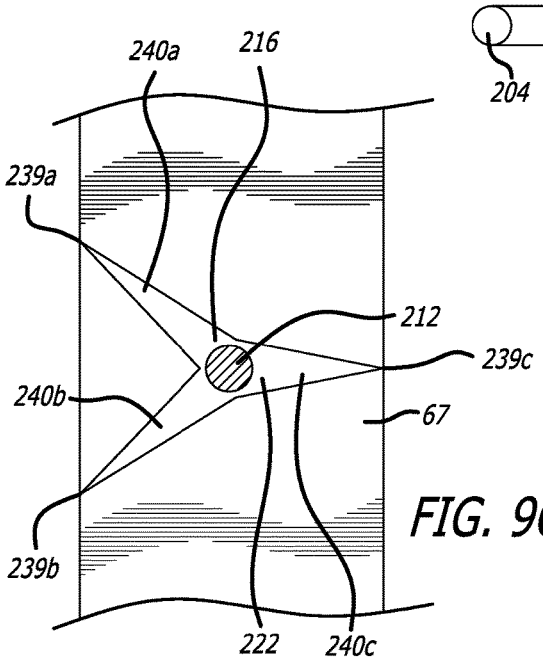

As shown in FIGS. 9A-9C, some or all of the compression element 216 is shaped according to a number of arms 240*a*, 240*b*, 240*c*. Each of these arms 240*a*, 240*b*, 240*c* structurally mounts and positions contact features 224*a*-*d*, such that contact features 224*a*-*d* can engage with, and compress, the mast 67. Contact features 224*a*-*c*, in such an implementation, are labeled 239*a*, 239*b*, 239*c*, respectively.

Figure 10A:
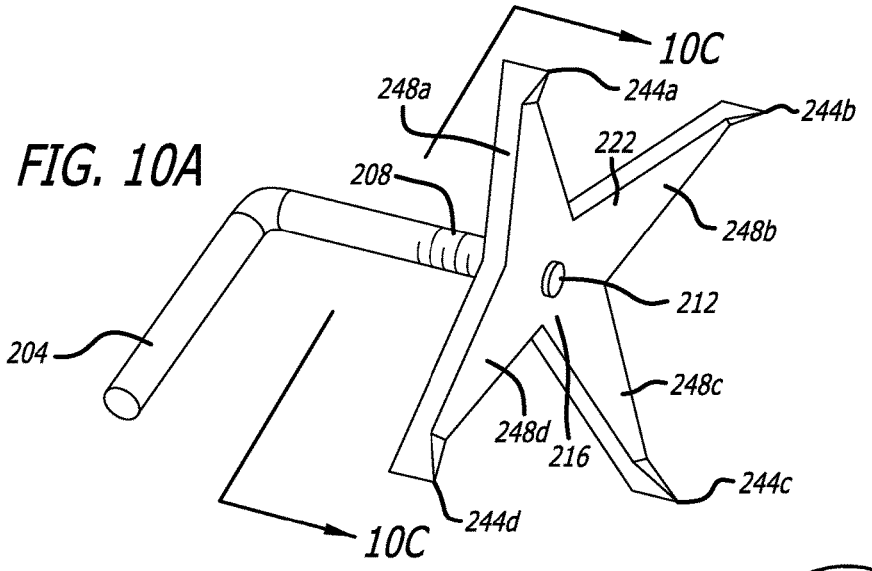
FIGS. 10A-10C are views of a bolt lever and a compression element according to exemplary implementations of the present disclosure.
Figure 10B:
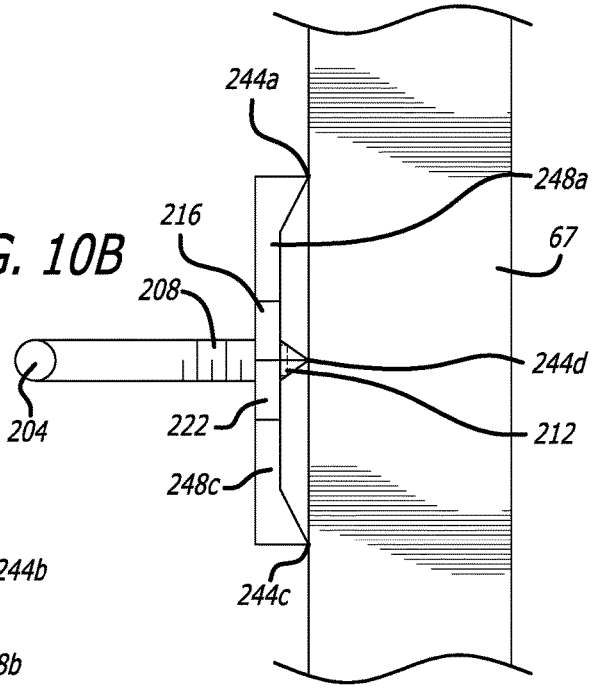
Figure 10C:
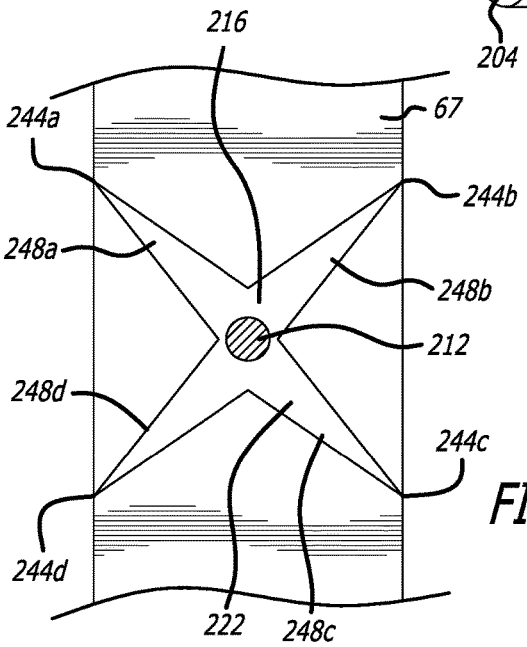

As shown in FIGS. 10A-10C, some or all of the compression element 216 is shaped according to a number of arms 248*a*, 248*b*, 248*c*, 248*d*. Each of these arms 248*a*, 248*b*, 248*c*, 248*d* structurally mounts and positions contact features 224*a*-*d*, such that contact features 224*a*-*d* can engage with and compress the mast 67. Contact features 224*a*-*d*, in such an implementation, are labeled 244*a*, 244*b*, 244*c*, 244*d*, respectively.

In operation, one more sign support systems 100 and/or bracket clamps 110 are loosely attached to a mast 67. Upon proper placement along the mast 67, the bolt lever 200 is manually rotated as described above and the compression element 216 is longitudinally translated towards the mast 67. The bolt lever 200 is rotated until the compression element 216 and/or contact features 224*a*-*d* contact the mast contact surface 213. The bolt lever 200 can then be left stationary, or can be continually rotated to further press the compression element 216 and/or contact features 224*a*-*d* into the mast contact surface 213 of the mast 67.

Alternatively, a sign 14 can be positioned within the receivers 174 of the one or more sign support systems 100 and/or bracket clamps 110 loosely attached to the mast 67, and the bolt lever 200 can be rotated such that the compression element 216 and/or contact features 224*a*-*d* press into the mast contact surface 213 while the sign 14 is within the one or more receivers 174.

In some implementations, the present disclosure provides a method for securing a portion of a sign 14, the method includes attaching a bracket clamp 110 to a mast 67, the bracket clamp 110 is operatively associated with a compression assembly 215 including a compression element 216, translating, using the compression assembly 215, the compression element 216 towards the mast 67, and contacting the mast 67 with portions of the compression element 216, the compression element 216 contacts a side surface, or a mast contact surface 213, of the mast 67 via a plurality of contact features 224*a*-*d*, each contact feature 224*a*-*d* contacts the mast contact surface 213 at a distinct location on the mast contact surface 213.

While some implementations have been illustrated and described, numerous modifications come to mind without significantly departing from the spirit of the disclosure, and the scope of protection is only limited by the scope of the accompanying claims. Further, the present disclosure provides a sign base and a sign assembly having increased structural strength, improved aesthetic design, a footprint facilitating flexible sign base placement and a wheel arrangement allowing easy sign assembly transportation.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A clamping system for securing a portion of a sign, comprising:

a mast;

a bracket clamp engageable with the mast, the bracket clamp including a receiver for receiving said portion of said sign;

a compression assembly for compressing the mast and the receiver towards each other; and a compression element movable relative to the receiver by the compression assembly, the compression element contacting a side surface of the mast via a plurality of contact features, each contact feature contacting the side surface of the mast at a distinct, non-continuous point on the side surface of the mast.

2. The clamping system of claim 1, wherein the clamping system is attached to a sign stand.

3. The clamping system of claim 2, wherein the sign stand is attached to two clamping systems, wherein the mast is attached to a first clamping system in a first orientation and the mast is attached to a second clamping system in a second orientation.

4. The clamping system of claim 1, wherein the clamping system receives and supports a section of a rigid sign.

5. The clamping system of claim 1, wherein the mast includes a first mast section and a second mast section, and a first clamping system is attached to the first mast section and a second clamping system is attached to the second mast section.

6. The clamping system of claim 1, wherein the compression element is made from steel.

7. The clamping system of claim 1, wherein the mast is made from aluminum.

8. The clamping system of claim 1, wherein the compression element includes three contact features.

9. The clamping system of claim 1, wherein the compression element includes four contact features.

10. The clamping system of claim 1, wherein the compression element includes a spherically-shaped section.

11. The clamping system of claim 1, wherein the compression element includes a cylindrically-shaped section.

12. The clamping system of claim 1, wherein the compression element includes a plurality of arms, each arm including one or more contact features.

13. A clamping system for securing a portion of a sign, comprising:

a mast;

a bracket clamp engageable with the mast, the bracket clamp including a receiver for supporting said portion of said sign;

a compression assembly for compressing the mast and the receiver towards each other; and a compression element movable relative to the receiver by the compression assembly, the compression element contacting a side surface of the mast with a plurality of contact features, each contact feature contacting the side surface of the mast at a distinct, non-continuous point closer to an edge of the side surface of the mast than to a center of the side surface of the mast.

14. The clamping system of claim 13, wherein a sign stand is attached to two clamping systems, wherein the mast is attached to a first clamping system in a first orientation and the mast is attached to a second clamping system in a second orientation, the first orientation being approximately 180 degrees relative to the second orientation.

15. The clamping system of claim 13, wherein the clamping system receives and supports a section of a rigid sign.

16. The clamping system of claim 13, wherein the mast is made from aluminum.

17. The clamping system of claim 13, wherein the compression element includes four contact features.

18. A clamping system for removably attaching a mast to a receiver, said clamping system comprising:

a mast;

a bracket clamp at least partially surrounding the mast;

a compression assembly operatively associated with the bracket clamp; and a compression element movable by the compression assembly, the compression element contacting a side surface of the mast with a plurality of contact features, each contact feature contacting the side surface of the mast at a distinct, non-continuous point on the side surface of the mast.

19. The clamping system of claim 18, wherein the clamping system receives and supports a section of a rigid sign and the mast is made from aluminum.

20. The clamping system of claim 18, wherein the compression element includes four contact features.

21. The clamping system of claim 18, wherein the compression element includes three contact features.

22. A method for securing a portion of a sign, the method comprising:

attaching a bracket clamp to a mast, the bracket clamp being operatively associated with a compression assembly including a compression element;

translating, using the compression assembly, the compression element towards the mast; and contacting the mast with portions of the compression element, the compression element contacting a side surface of the mast via a plurality of contact features, each contact feature contacting the side surface of the mast at a distinct, non-continuous point on the side surface of the mast.

* * * * *